US010788276B2

(12) United States Patent
Satern

(10) Patent No.: US 10,788,276 B2
(45) Date of Patent: Sep. 29, 2020

(54) RIFLE TO FIRE PISTOL CARTRIDGES

(71) Applicant: Liberty Barrels, Inc., Estherville, IA (US)

(72) Inventor: Steven R. Satern, Estherville, IA (US)

(73) Assignee: Liberty Barrels, Inc., Estherville, IA (US)

( * ) Notice: Subject to any disclaimer, the term of this patent is extended or adjusted under 35 U.S.C. 154(b) by 0 days.

(21) Appl. No.: 15/612,393

(22) Filed: Jun. 2, 2017

(65) Prior Publication Data

US 2018/0347924 A1 Dec. 6, 2018

(51) Int. Cl.

| | |
|---|---|
| ***F41A 3/26*** | (2006.01) |
| ***F41A 3/64*** | (2006.01) |
| ***F41A 19/46*** | (2006.01) |
| ***F41A 9/70*** | (2006.01) |
| ***F41A 9/59*** | (2006.01) |
| ***F41C 7/00*** | (2006.01) |
| ***F41A 9/65*** | (2006.01) |
| ***F41A 9/69*** | (2006.01) |
| ***F41A 3/66*** | (2006.01) |
| ***F41A 9/55*** | (2006.01) |
| ***F41A 5/02*** | (2006.01) |
| ***F41A 3/54*** | (2006.01) |

(52) U.S. Cl.

CPC ..... *F41A 3/26* (2013.01); *F41A 3/54* (2013.01); *F41A 3/64* (2013.01); *F41A 3/66* (2013.01); *F41A 5/02* (2013.01); *F41A 9/55* (2013.01); *F41A 9/59* (2013.01); *F41A 9/65* (2013.01); *F41A 9/69* (2013.01); *F41A 9/70* (2013.01); *F41A 19/46* (2013.01); *F41C 7/00* (2013.01)

(58) Field of Classification Search

CPC .... F41A 11/02; F41A 3/26; F41A 9/71; F41A 3/64; F41A 19/46

USPC ..... 42/18

See application file for complete search history.

(56) References Cited

U.S. PATENT DOCUMENTS

| | | | | | |
|---|---|---|---|---|---|
| 1,433,945 | A | * | 10/1922 | Eickhoff | F41A 3/26 89/154 |
| 2,780,145 | A | * | 2/1957 | Dieudonne | F41A 3/32 42/16 |
| 3,771,415 | A | * | 11/1973 | Into | F41A 3/78 42/16 |
| 4,098,016 | A | | 7/1978 | Foote | |
| 4,169,329 | A | | 10/1979 | Atchisson | |
| 4,231,177 | A | | 11/1980 | Foote | |
| 4,335,643 | A | * | 6/1982 | Gal | F41A 3/54 42/25 |

(Continued)

FOREIGN PATENT DOCUMENTS

| | | | |
|---|---|---|---|
| FR | 1050325 | * | 9/1953 |

*Primary Examiner* — Stephen Johnson

(74) *Attorney, Agent, or Firm* — McKee, Voorhees & Sease, PLC

(57) ABSTRACT

A rifle platform with semi-automatic, select fire, and/or fully automatic shooting options uses a pistol cartridge. The rifle barrel includes an extension having a ramp for loading the cartridges and having a key way for the shell extractor. The magazine of the rifle is mounted to the lower receiver so as to load the cartridges in a direction perpendicular to the rifle barrel. The magazine follower automatically locks the bolt after the last cartridge is fired. The bolt and bolt carrier are integrally machined, and fully enclose the cartridge to preclude out of battery firing.

12 Claims, 22 Drawing Sheets

(56) References Cited

U.S. PATENT DOCUMENTS

| | | | | | |
|---|---|---|---|---|---|
| 4,358,986 | A * | 11/1982 | Giorgio | F41A 3/26 | 89/1.4 |
| 4,567,810 | A * | 2/1986 | Preston | F41A 17/38 | 89/142 |
| 4,833,970 | A * | 5/1989 | Wilhelm | F41A 19/33 | 89/141 |
| 5,499,569 | A * | 3/1996 | Schuetz | F41A 3/54 | 42/25 |
| 6,374,720 | B1 * | 4/2002 | Tedde | F41A 1/06 | 42/78 |
| 7,444,775 | B1 | 11/2008 | Schuetz | | |
| 7,934,443 | B1 | 5/2011 | Bennett | | |
| 8,713,838 | B2 | 5/2014 | Ubl et al. | | |
| 9,194,635 | B1 | 11/2015 | Gibbens et al. | | |
| 9,841,251 | B2 * | 12/2017 | Cheng | F41A 17/36 | |
| 2010/0162604 | A1 * | 7/2010 | Dubois | F41A 11/02 | 42/18 |
| 2011/0168009 | A1 * | 7/2011 | Robb | F41A 3/54 | 89/194 |

* cited by examiner

RIFLE TO FIRE PISTOL CARTRIDGES

FIELD OF THE INVENTION

The present invention relates to a semi-automatic, select fire, and/or fully automatic rifle platform capable of shooting a pistol cartridge. This original rifle equipment includes a straight, perpendicularly mounted magazine, an ejector in the upper receiver, a feed ramp in the lower receiver and an integral bolt, which encapsulates the cartridge in the chamber.

BACKGROUND OF THE INVENTION

Rifles having firing options, including those heretofore known as semi-automatic, select fire (such as three shot burst), and fully automatic, are well known in the art. These semi-automatic, select fire, and/or fully automatic guns are commonly used by military personnel, law enforcement, competitive shooters, and gun enthusiasts.

To become proficient, a great deal of practice and training are required. The cost of the high caliber ammunition becomes an economic consideration for the users of such guns. Therefore, conversion kits have become available to convert the AR15, or similar weapons, to use smaller caliber cartridges, such as the 9 mm and 45 ACP used in pistols and handguns, which are more cost efficient. However, such conversion kits require the rifle to be partially disassembled with replacement parts being substituted for original parts. The conversion kit then must be removed and the original equipment reassembled before the rifle can be used with high caliber cartridges as designed.

There are several different styles of conversion kits, varying from metal inserts that go into the magazine well of the lower receiver, to all new lower receivers that use conventional hand gun magazines. These conversion kits have several issues.

First, they use currently commercial available magazines which have an angle that feeds the cartridge up the magazine to the chamber, which creates a tendency to jam due to the feed angle. Also, the inclined feed angle of the magazine requires a greater spring force to push or feed the cartridges into the chamber in front of the bolt as compared to a perpendicular feed angle. Extended cartridge pistol magazines tend to jam when trying to feed the cartridges into a rifle. The more cartridges that go into a magazine, the less reliable the magazine is. Furthermore, the pistol magazines used in the conversion kits generally are not as durable and can be easily damaged, which further impedes functionality of the rifle firing system.

Secondly, when the rifle bolt carrier is released from the charging position, there often is bolt bounce or bolt slap. As the weight of the carrier picks up a cartridge from the magazine and places the cartridge in the chamber, the carrier slaps the bolt face and bounces back, while still having the live cartridge in the bolt face being held by the extractor. If the trigger is pulled at the incorrect time, there is a possibility of an out of battery firing wherein the cartridge detonates outside of the chamber. Such an out of battery firing can rupture the case and cause bodily injury and may damage and/or destroy the firearm.

Therefore, there is a need for a semi-automatic, select fire, and/or fully automatic rifle platform which addresses the issues of the prior art.

Accordingly, a primary objective of the present invention is the provision of a semi-automatic, select fire, and/or fully automatic rifle which is designed and built to shoot pistol caliber cartridges, without utilizing a conversion kit.

A further objective of the present invention is the provision of an improved magazine for a semi-automatic, select fire, and/or fully automatic rifle which has a large capacity that feeds into the chamber of the upper receiver in a direction perpendicular to the chamber axis.

Another objective of the present invention is the provision of a semi-automatic, select fire, and/or fully automatic rifle having an integral bolt carrier which fully encloses the cartridge inside the chamber so as to preclude out of battery firing.

Another objective of the present invention is the provision of a semi-automatic, select fire, and/or fully automatic rifle having an ejection system in the upper receiver.

Still another objective of the present invention is the provision of a semi-automatic, select fire, and/or fully automatic rifle having a feed ramp in the lower receiver for the cartridge.

A further objective of the present invention is the provision of a semi-automatic, select fire, and/or fully automatic rifle having interchangeability of the majority of the parts commonly found on the M16A1 M16A2, the current M-4 carbine, and commercial variations.

Another objective of the present invention is the provision of a semi-automatic, select fire, and/or fully automatic rifle has reliability and has an extended service life.

These and other objectives will come apparent from the following description of the invention.

SUMMARY OF THE INVENTION

The semi-automatic, select fire, and/or fully automatic rifle has an upper receiver to accept an integral bolt and a lower receiver to accept a magazine. The magazine is designed to feed the cartridge straight into the chamber in the upper housing, in a path perpendicular to the chamber longitudinal axis. The bolt encloses the rear of the cartridge in the chamber to preclude out of battery firing. The lower receiver includes a feed ramp to direct the cartridge from the magazine into the chamber. The upper receiver has an ejector for discharging the cartridge from the bolt face then the upper receiver. The magazine includes a mechanism to lock the bolt after the last shot. The rifle is designed to shoot pistol or handgun caliber ammunition, without removing or exchanging components.

BRIEF DESCRIPTION OF THE DRAWINGS

FIG. 3A is a side elevation view of the bolt.

FIG. 3B is a bottom plan view of the bolt.

FIG. 3C is another side elevation view of the bolt from the side opposite that is shown in FIG. 3A.

FIG. 3D is a top plan view of the bolt.

FIG. 3E is a view similar to 3C, with the bolt rotated slightly about its longitudinal axis.

FIG. 4A is a sectional view taken along line A-A of FIG. 3A.

FIG. 4B is a sectional view taken along line B-B of FIG. 3B.

FIG. 4C is a sectional view taken along lines C-C of FIG. 3C.

FIG. 4D is a sectional view taken along lines D-D of FIG. 3D.

FIG. 5 is an elevation view from the forward end of the bolt.

FIG. 6 is an elevation view from the rear end of the bolt.

DETAILED DESCRIPTION OF THE DRAWINGS

Figure 1:
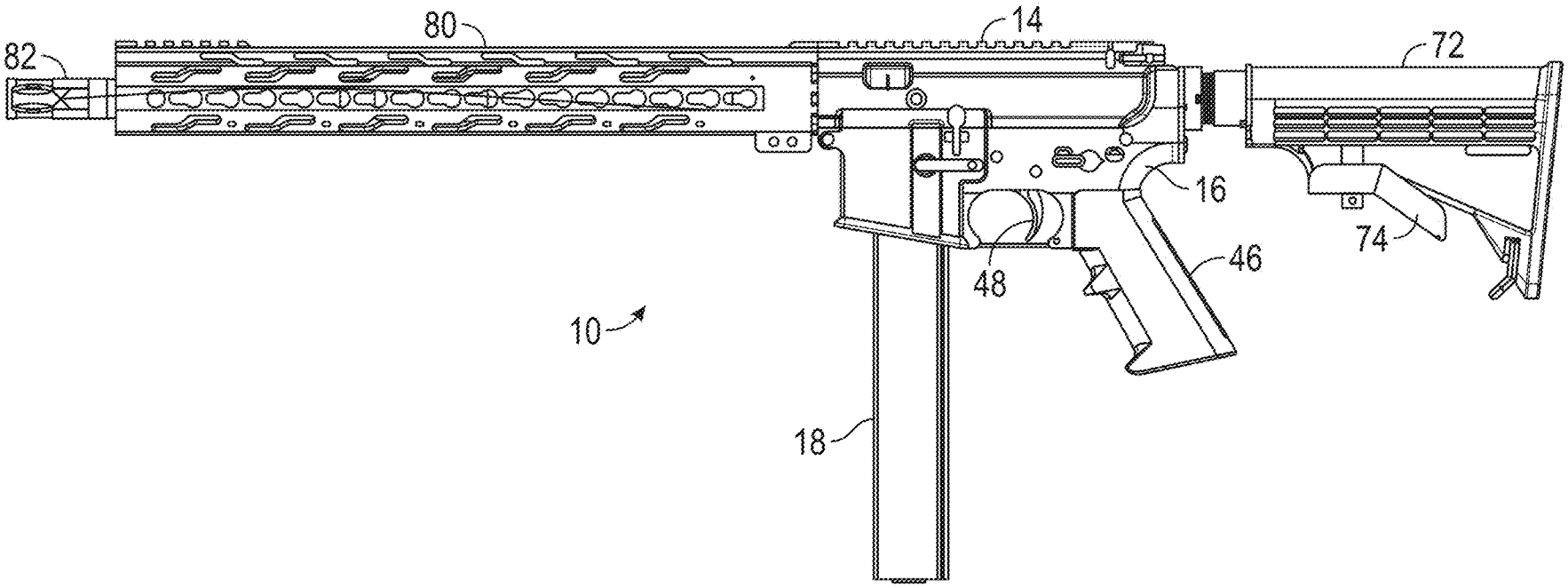
FIG. 1 is a side elevation view of the semi-automatic, select fire and/or automatic rifle according to the present invention.

A semi-automatic, select fire, and/or fully automatic rifle according to the present invention is generally designated in the drawings by the reference numeral 10. The invention focuses on several key components of the rifle 10, including the bolt 12, the upper receiver 14, the lower receiver 16, and the magazine 18.

Figure 2:
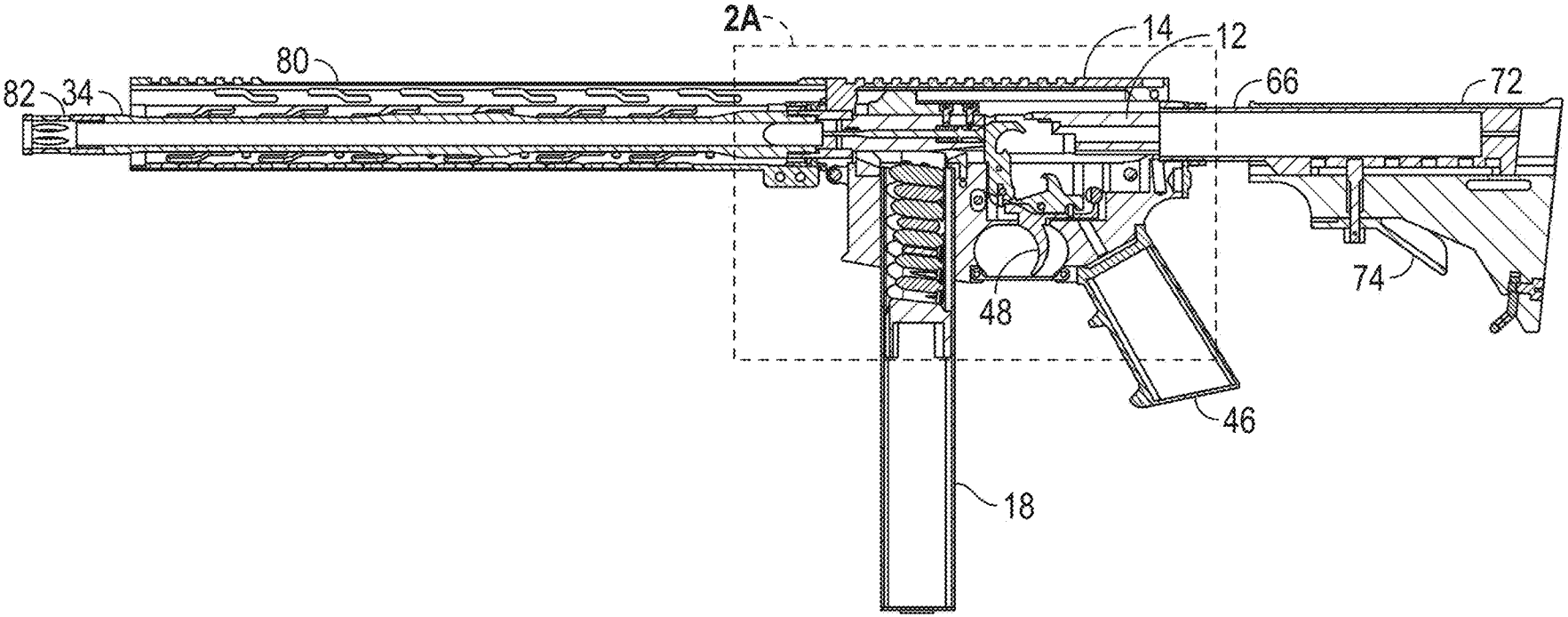
FIG. 2 is a sectional view along the longitudinal axis of the rifle.
Figure 2A:
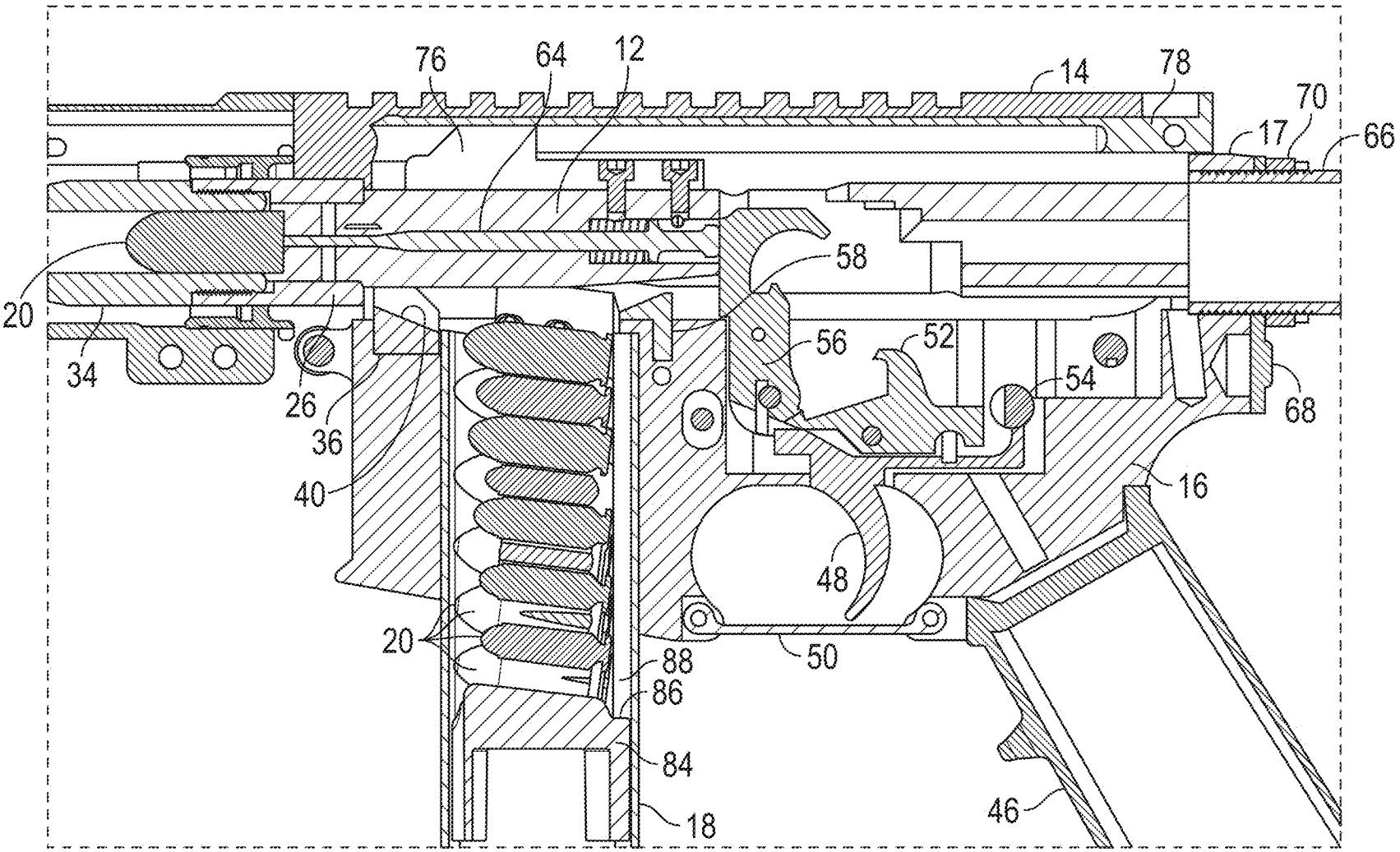
FIG. 2A is an enlarged view of FIG. 2.
Figure 2B:
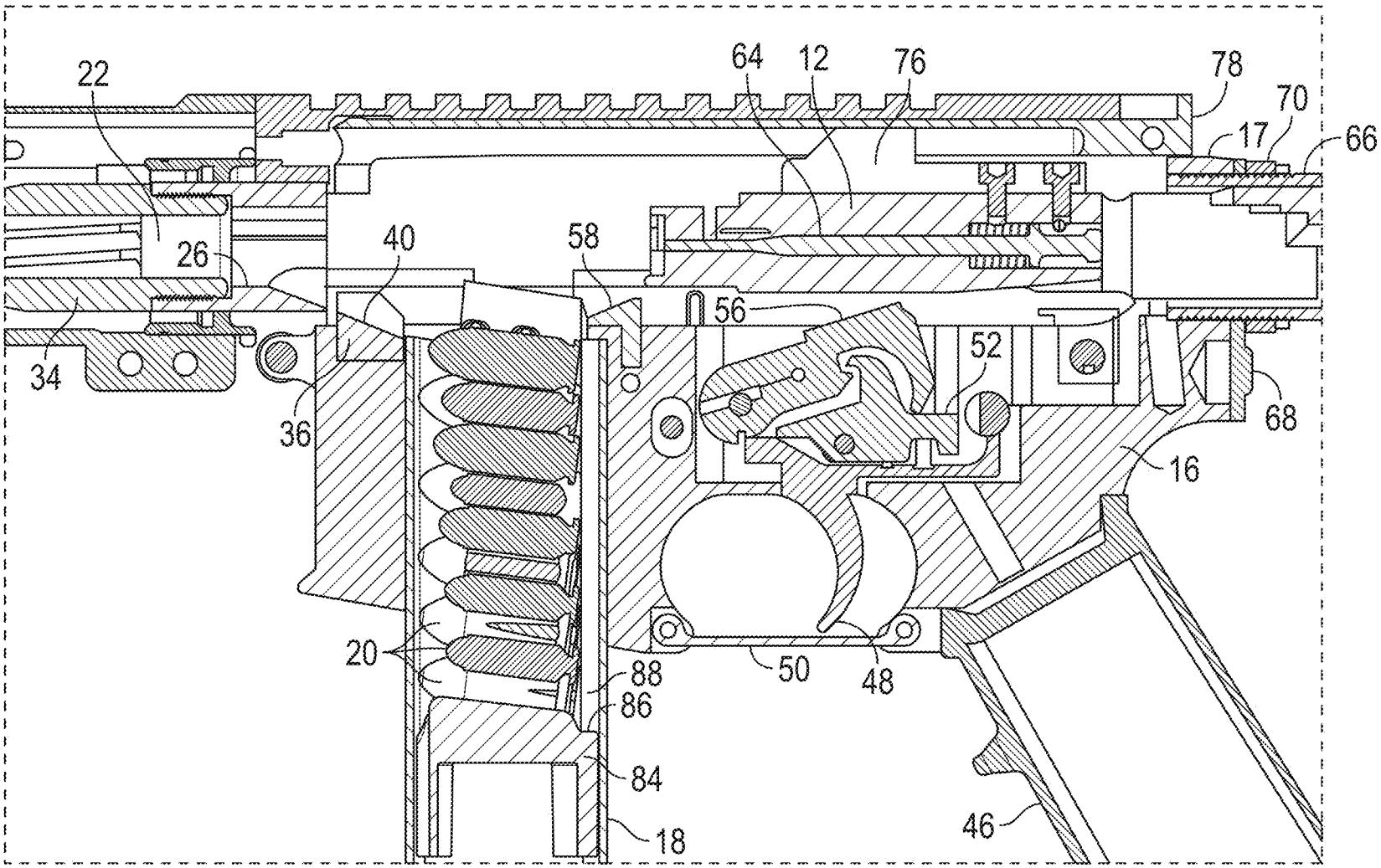
FIG. 2B is a sectional view similar to FIG. 2A, but showing the chamber empty without a cartridge and the bolt locked back.
Figure 2C:
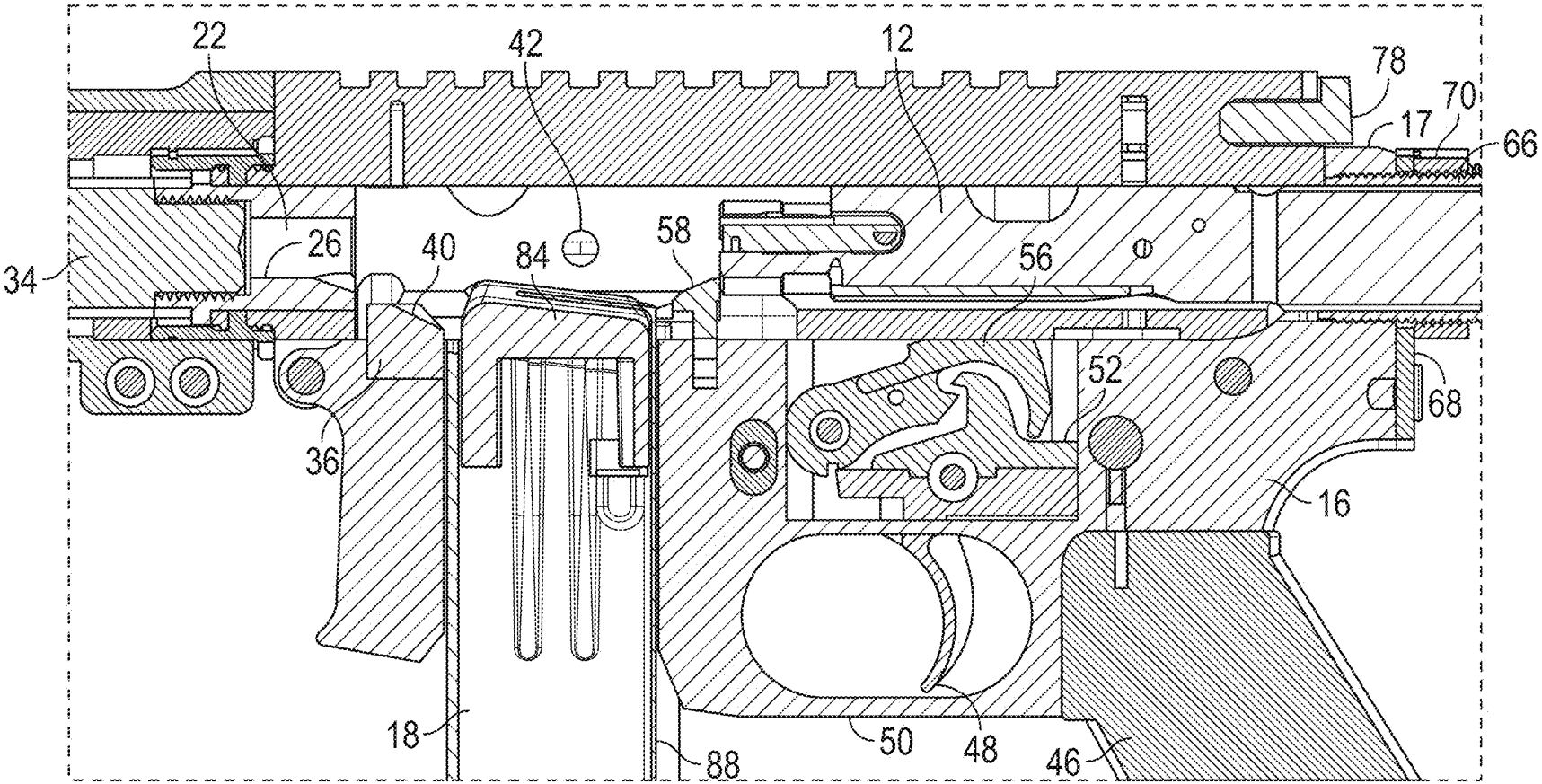
FIG. 2C is a sectional view similar to FIG. 2B with the magazine follower extended to the bolt lock position after the last cartridge is fired.
Figure 3A:
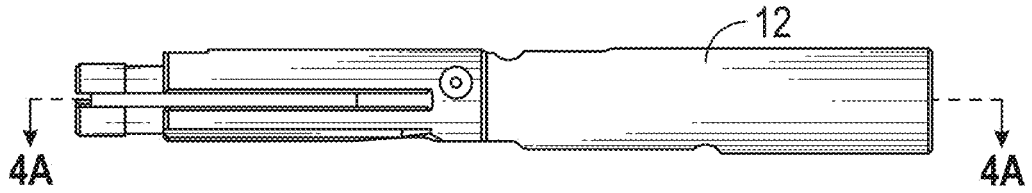
FIGS. 3A-3E, 4A-4D, 5 and 6 show the bolt of the rifle, according to the present invention.
Figure 3B:
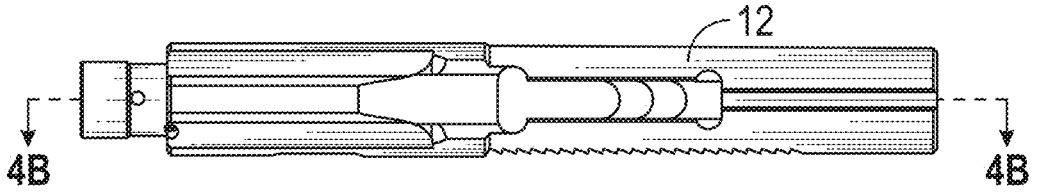
Figure 3C:
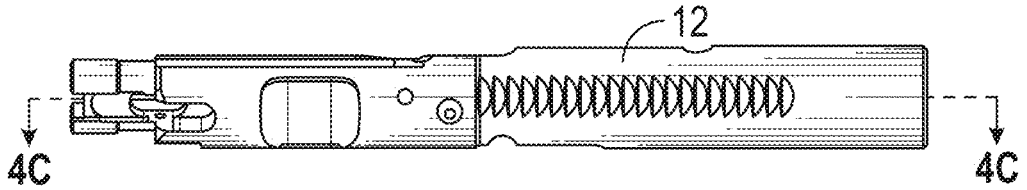
Figure 3D:
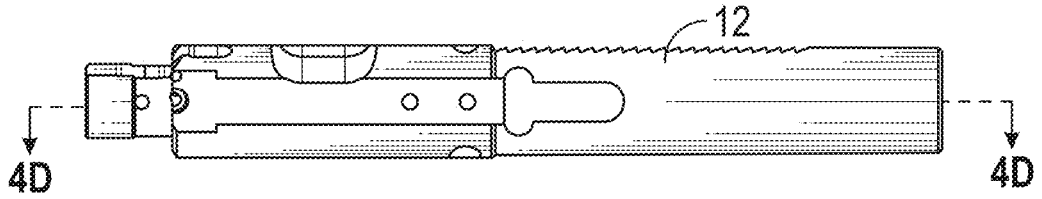
Figure 3E:
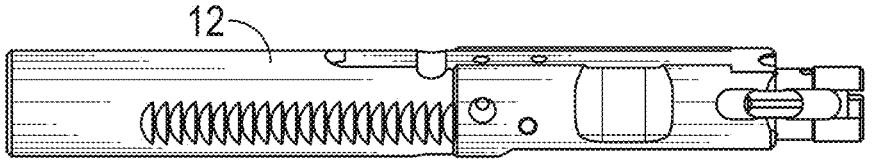
Figure 4A:
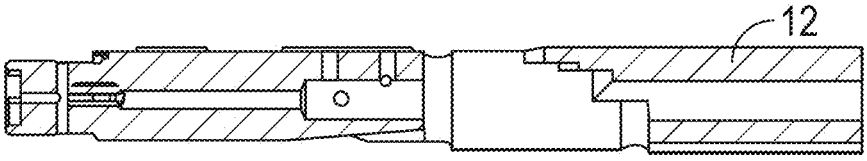
Figure 4B:
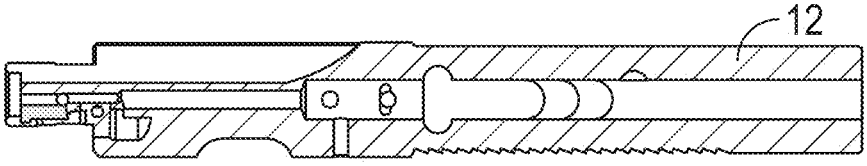
Figure 4C:
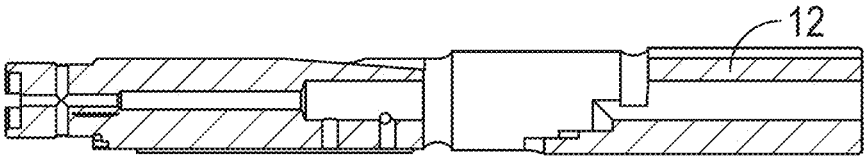
Figure 4D:
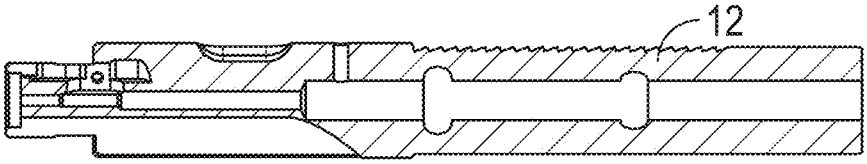
Figure 5:
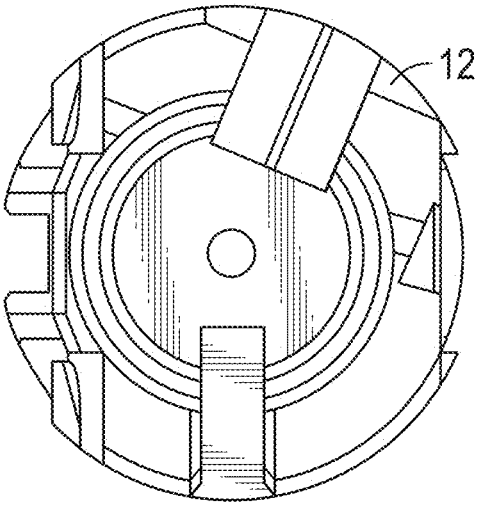
Figure 6:
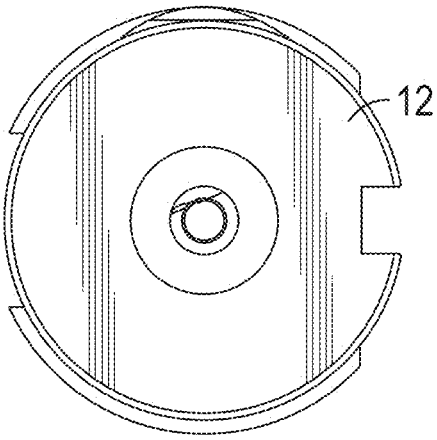

The bolt 12 is shown in FIGS. 3-6. The bolt 12 has a one piece, integral construction. The bolt is slideably received within the upper receiver 14 for movement between a retracted rear position which allows the cartridge 20 to be fed into the chamber 22 in the upper receiver 14, and a forward firing position. The forward end of the bolt 12 has a recess 17 which receives the rear end of the cartridge. When the bolt 12 is in the firing position, the forward end of the bolt fully encloses the rear of the cartridge 20, as shown in FIG. 2A. This complete enclosure of the cartridge 20 by the chamber and bolt precludes out of batter firing, and thus prevents damage to the rifle 10 and injury to the user and/or firearm. This integrated bolt and carrier 13 design allows the cartridge case to be secure inside the chamber before the rifle can be fired. Also, the hand over hand type bolt and chamber design will not permit case rupture, even in the event of bolt slap (which is normally eliminated by the bolt 12). The solid, one piece bolt carrier 12, 13 eliminates the need to disassemble multiple parts for cleaning, as in the prior art, and increases bolt mass for the blow back system.

Figure 9:
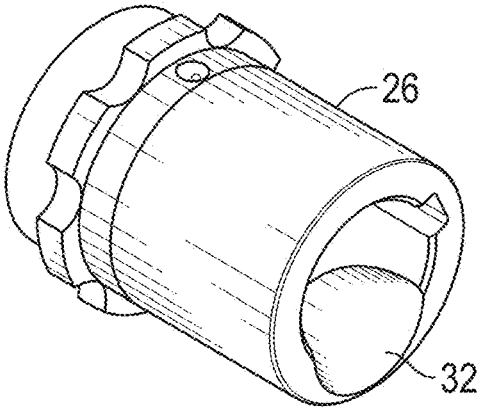
FIG. 9 is a perspective view of the extension of the rifle.
Figure 9A:
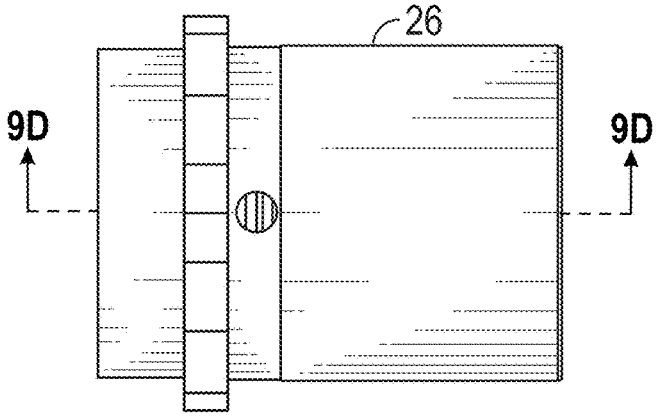
FIG. 9A is a top elevation view of the extension.
Figure 9B:
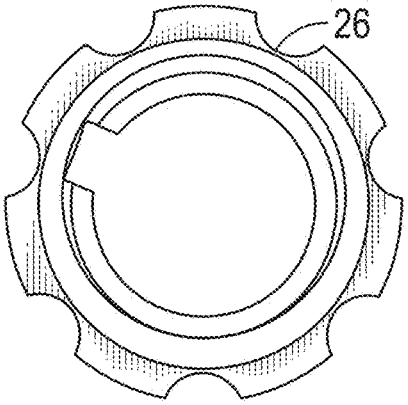
FIG. 9B is an elevation view of the extension from the forward end.
Figure 9C:
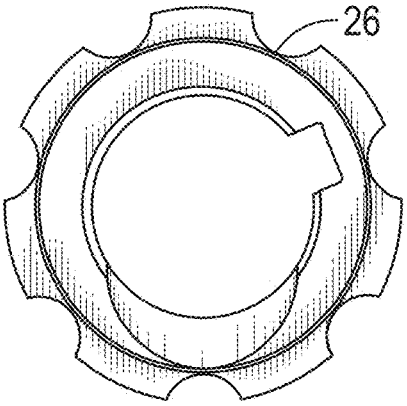
FIG. 9C is another elevation view of the extension from the rearward end.
Figure 9D:
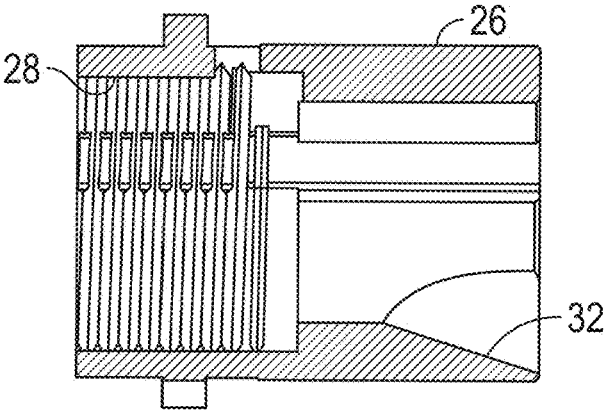
FIG. 9D is a sectional view taken along lines D-D of FIG. 9A.
Figure 10:
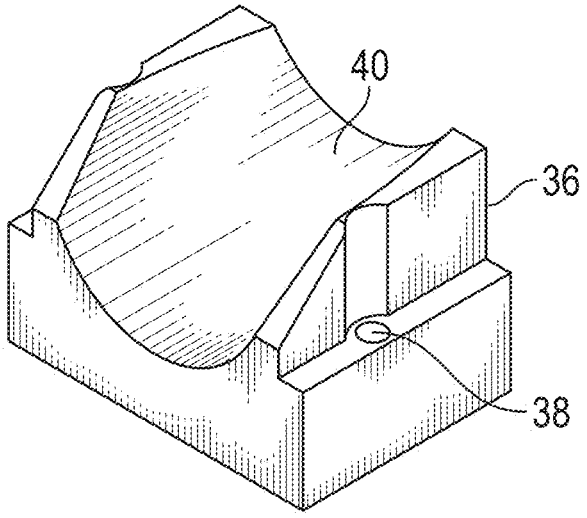
FIG. 10 is a perspective view of the feed ramp for the rifle.
Figure 10A:
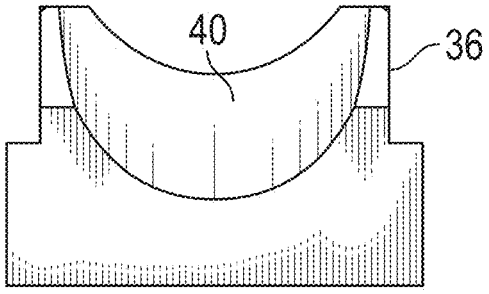
FIGS. 10A and 10B are opposite end elevation views of the feed ramp.
Figure 10B:
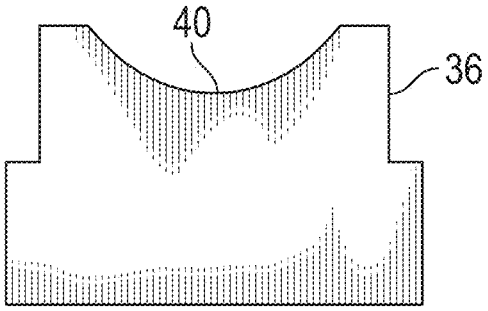
Figure 10C:
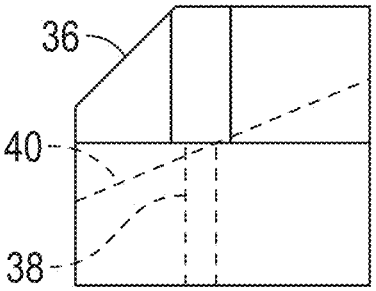
FIG. 10C is a side elevation view of the feed ramp.
Figure 10D:
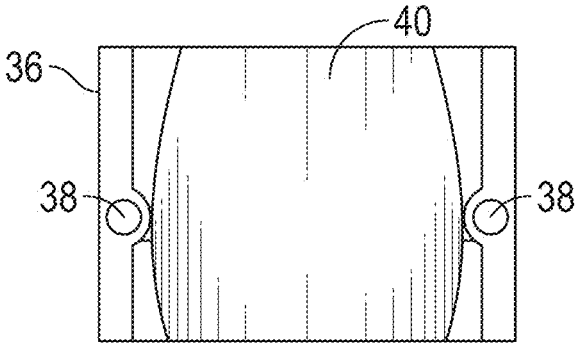
FIG. 10D is a top plan view of the feed ramp.
Figure 11:
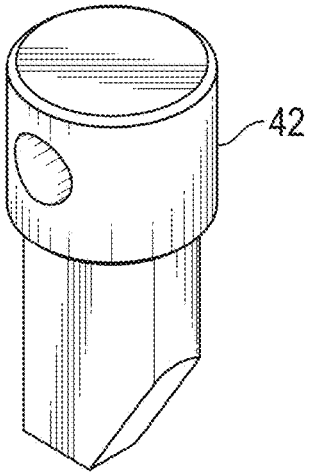
FIG. 11 is a perspective view of the ejector for the rifle.
Figure 11A:
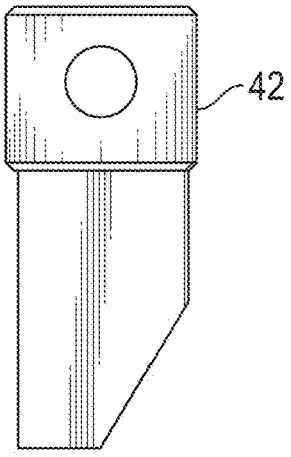
FIG. 11A is a side elevation view of the ejector.
Figure 11B:
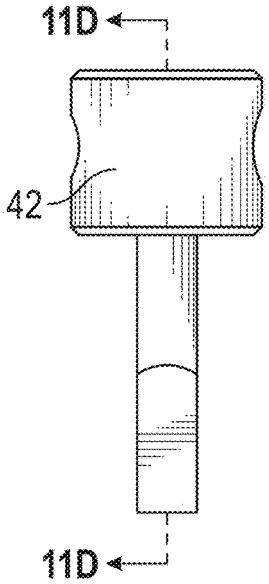
FIG. 11B is another elevation view of the ejector, turned at 90° from FIG. 11A.
Figure 11C:
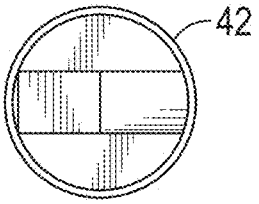
FIG. 11C is a bottom plan view of the ejector.
Figure 11D:
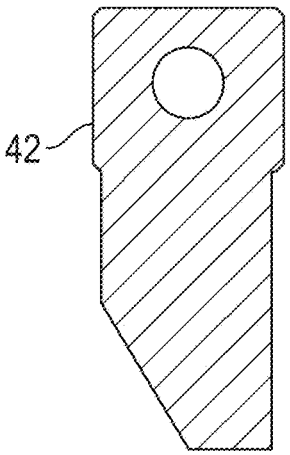
FIG. 11D is a sectional view of the ejector taken along line D-D of FIG. 11B.

An extension 26 is mounted on the forward end of the upper receiver 14. The extension is shown in FIGS. 9-9D. The extension 26 threads onto the barrel 34 which slides into the forward end of the upper receiver 14. The extension 26 also has an internal inclined ramp 32 which facilitates movement of the cartridge 20 into the barrel 34 of the rifle 10. The reduced diameter portion 15 on the end of the bolt 12 pushes the cartridge 20 through the extension and into the barrel 34, as seen in FIG. 2A. This steel extension 26 provides a ring or band around the cartridge and chamber, and discourages or prevents use of non-compatible cartridges.

A feed ramp 36 is mounted on the lower receiver 16, such as by roll pins driven down, extending through holes 38 on each side of the ramp 36. The ramp 36 has an inclined surface 40 which aligns with the ramp 32 of the extension 26, as best seen in FIG. 2A, to provide a smooth feed of the cartridge 20 from the magazine 18.

Figure 7:
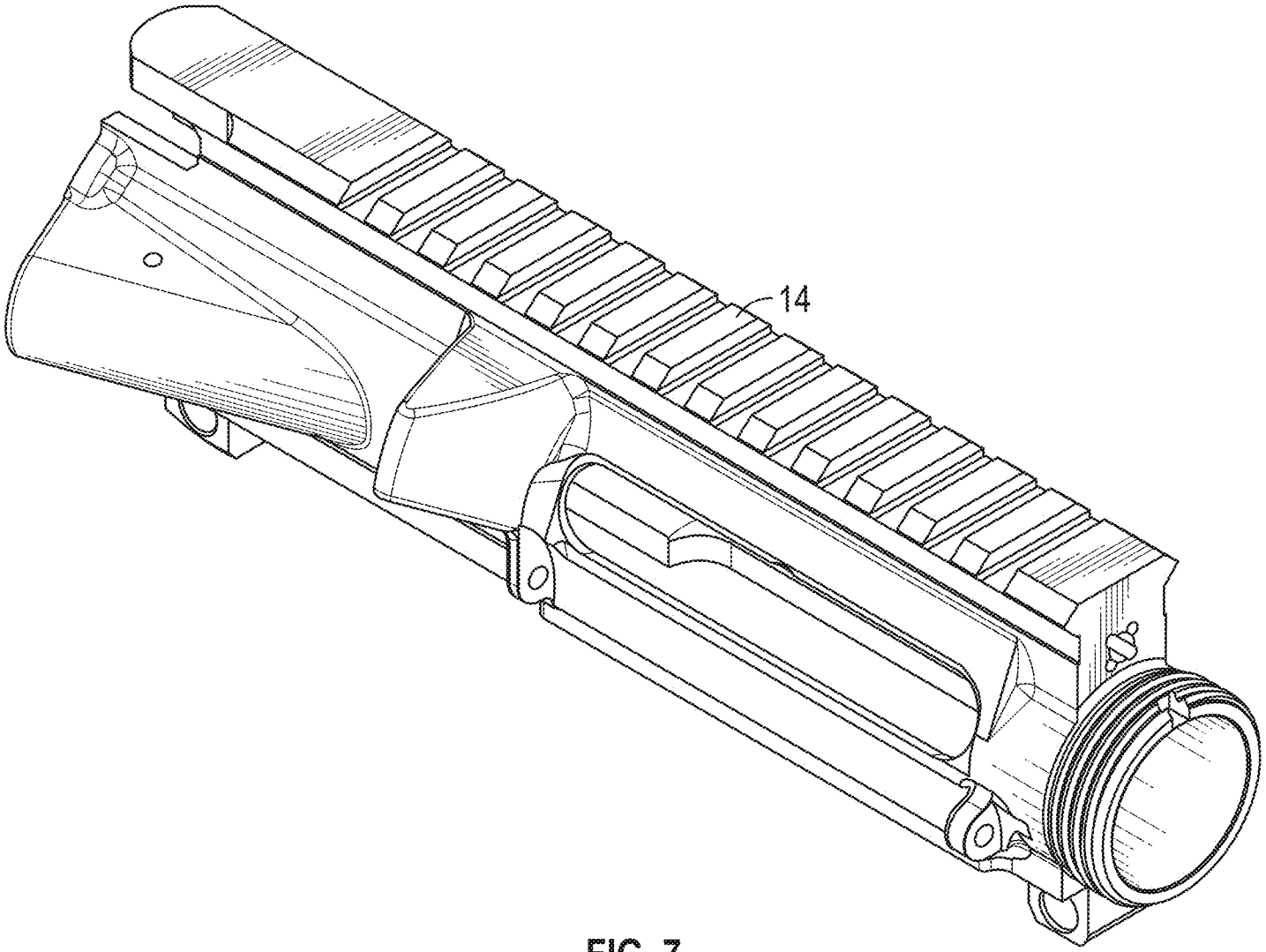
FIG. 7 is a perspective view of the upper receiver of the rifle.
Figure 7A:
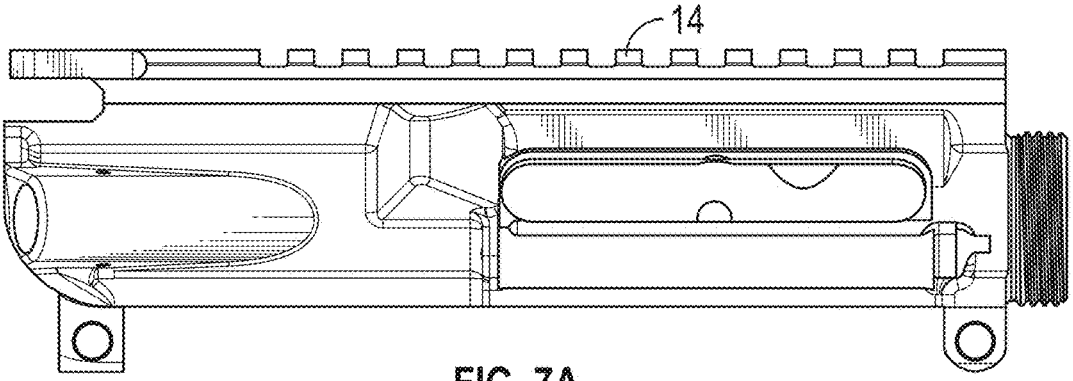
FIGS. 7A and 7B are side elevation views of the upper receiver, from opposite sides.
Figure 7B:
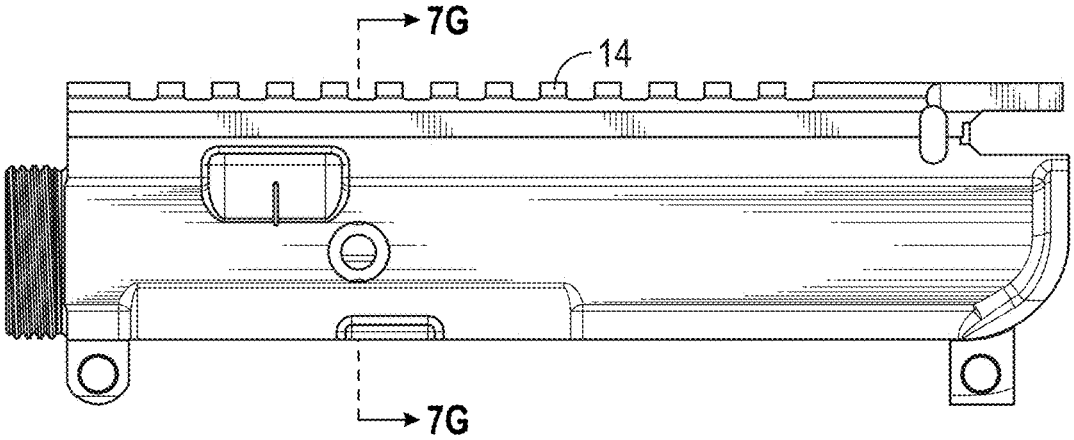
Figure 7C:
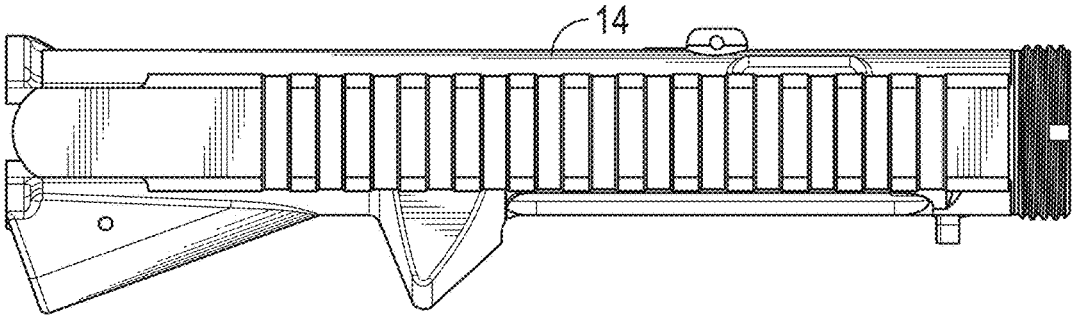
FIG. 7C is a top plan view of the upper receiver.
Figure 7D:
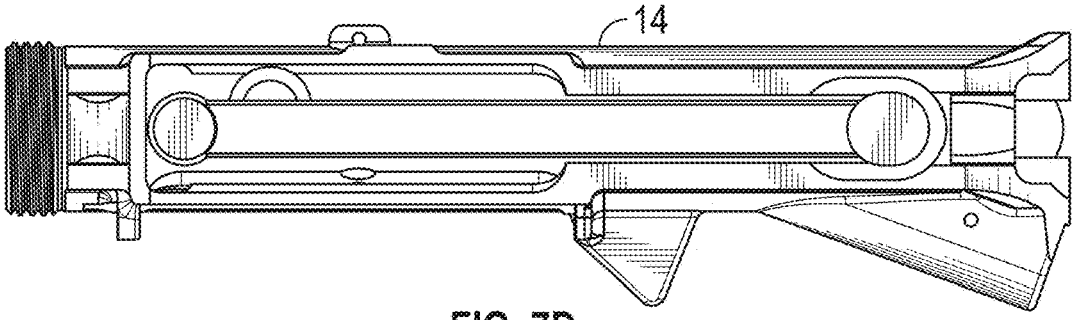
FIG. 7D is a bottom plan view of the upper receiver.
Figure 7E:
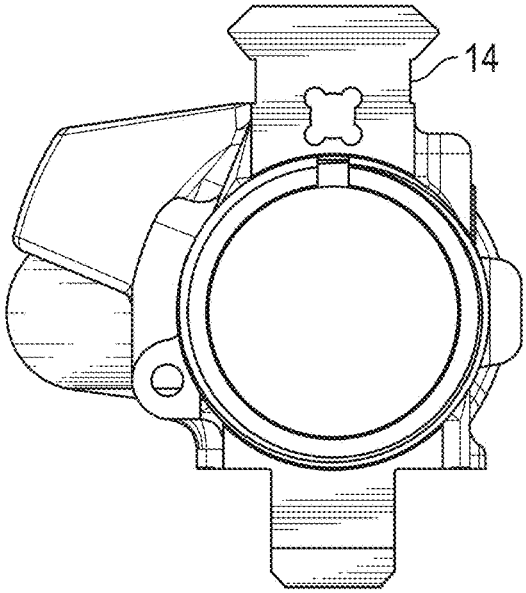
FIG. 7E is an end elevation view of the upper receiver from the forward end.
Figure 7F:
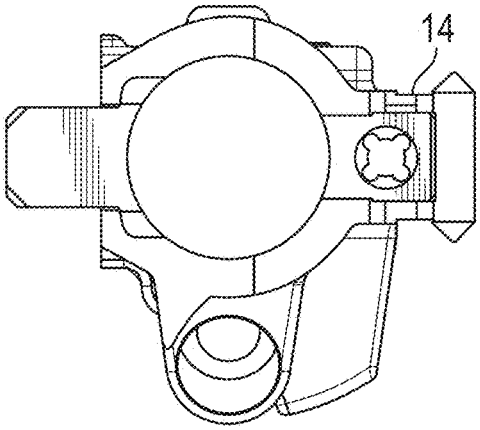
FIG. 7F is an end elevation view at 90° of the upper receiver from the rearward end.
Figure 7G:
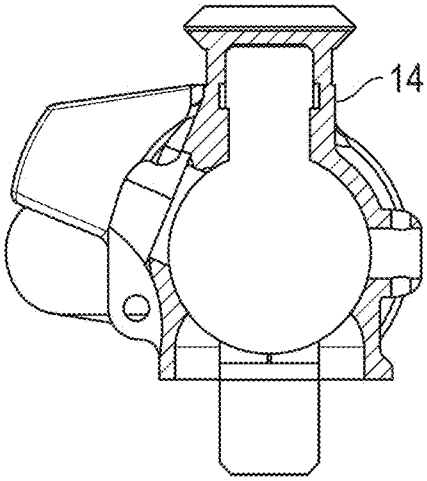
FIG. 7G is a sectional view of the upper receiver taken along lines 7G of FIG. 7B.
Figure 7H:
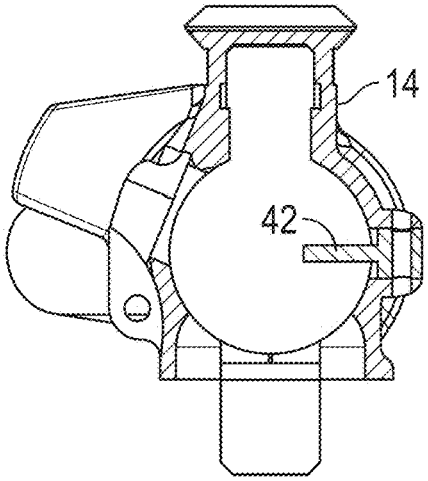
FIG. 7H is a view similar to FIG. 7G showing the upper receiver, showing the ejector in the upper receiver.
Figure 8:
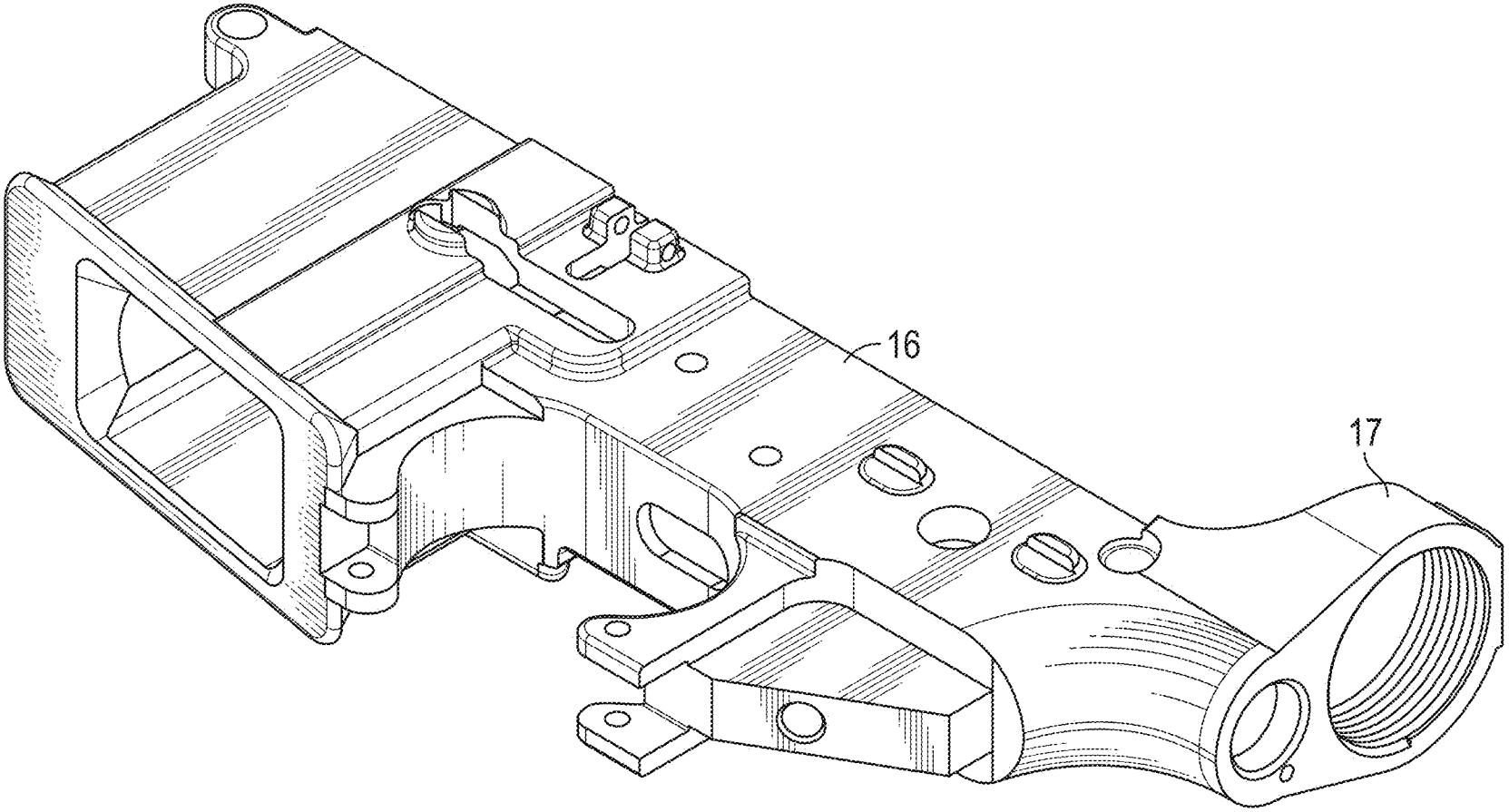
FIG. 8 is a perspective view of the lower receiver.
Figure 8C:
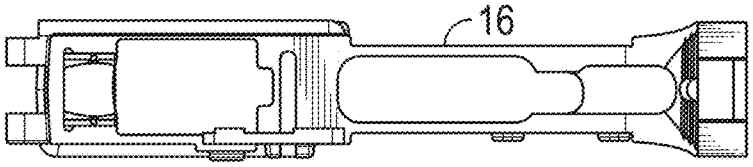
FIG. 8C is a top plan view of the lower receiver.
Figure 8D:
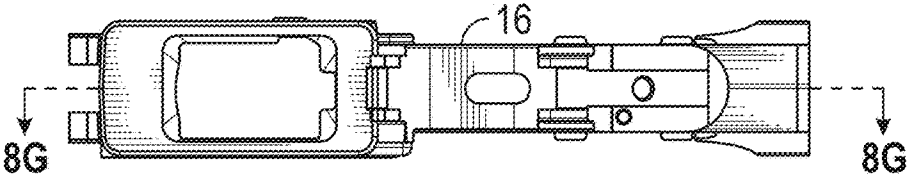
FIG. 8D is a bottom plan view of the lower receiver.
Figure 8A:
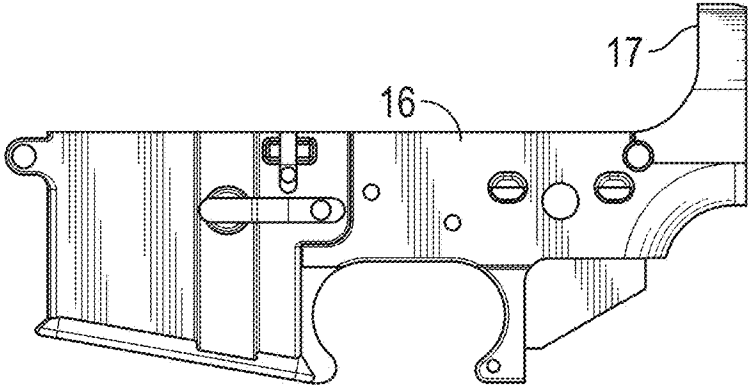
FIG. 8A is an elevation view from one side of the lower receiver.
Figure 8B:
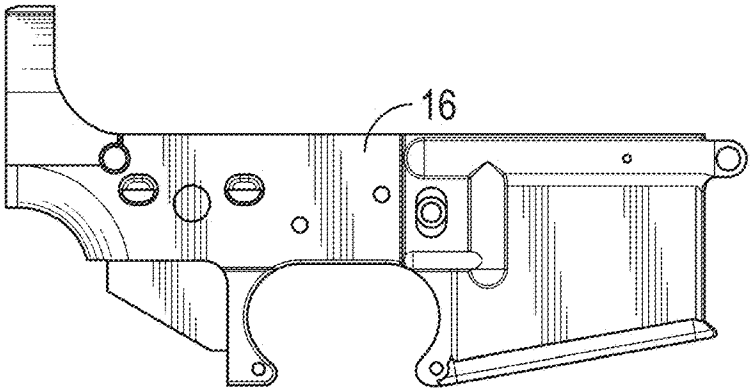
FIG. 8B is an elevation view from the opposite side of the lower receiver.
Figure 8E:
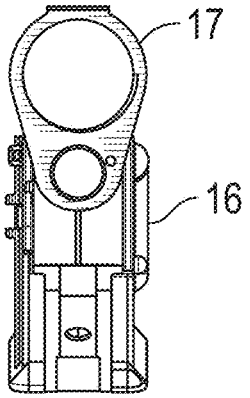
FIG. 8E is an elevation view from the rear end of the lower receiver.
Figure 8F:
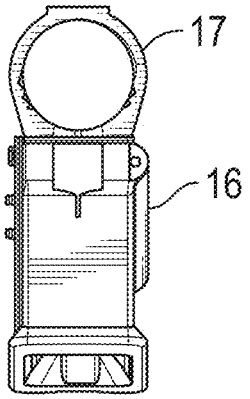
FIG. 8F is an elevation view from the front end of the lower receiver.
Figure 8G:
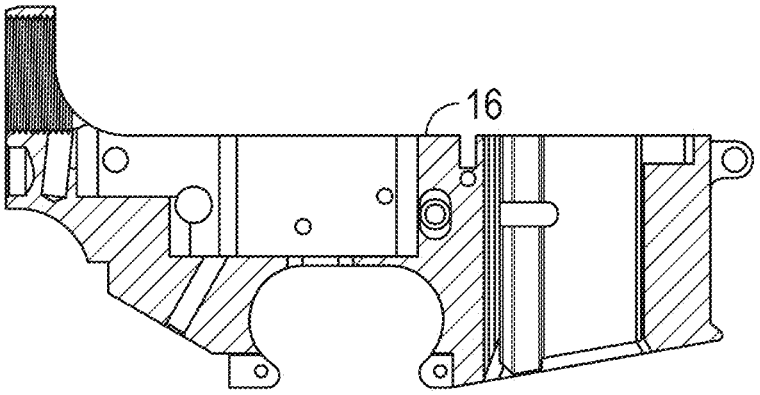
FIG. 8G is a sectional view of the lower receiver taken along lines 8G-8G of FIG. 8D.

The upper receiver 14 includes an ejection system for ejecting the expended shell case from the rifle 10. The ejection system includes an ejector 42 mounted in the upper receiver 14, as compared to prior art ejectors which are spring mounted on the bolt face. A roll pin pins the ejector 42 to the upper receiver 14 via a hole in the head of the ejector as best seen in FIG. 7H.

The upper receiver 14 and the lower receiver 16 are coupled by pins, as is known in the art. A pistol grip 46 is mounted on the lower receiver 16 in a conventional manner.

A conventional trigger 48 is pinned to the lower receiver 16, and a trigger guard 50 is pinned to the lower receiver 16 to prevent accidental actuation of the trigger 48. Other conventional components of the lower receiver include the sear 52, the safety latch 54, the hammer 56, the bolt stop 58, and the magazine catch push button 60. Components of the bolt 12 include the extractor 62, and the firing pin 64. An extractor 62 is mounted in a slot in the bolt 12.

A conventional buffer tube 66 is threadably mounted to the collar 17 on the lower receiver 16, with the butt stock 72 being mounted on the buffer tube, in known manners. A conventional buffer tube plate 68 is provided on the buffer tube 66, is well known in the art. A buffer tube retaining nut 70 is on the rearward end of the upper receiver 14. The butt stock lock latch 74 is also provided on the butt stock 72, as is known in the art.

Figure 12A:
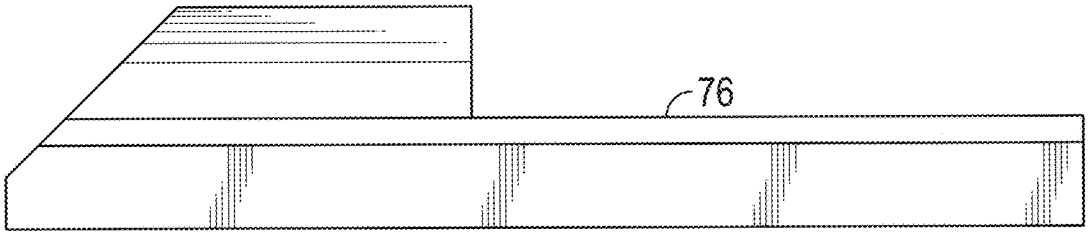
FIG. 12A is a side elevation view of the guide.
Figure 12B:
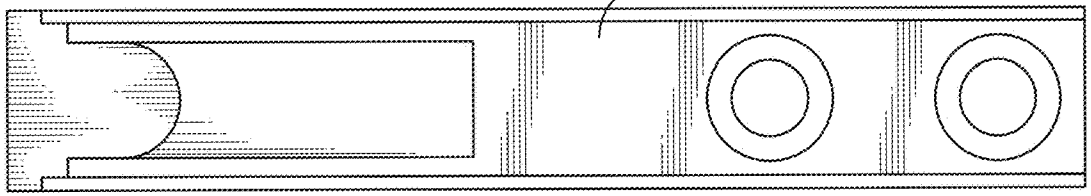
FIG. 12B is a top plan view of the guide.
Figure 12D:
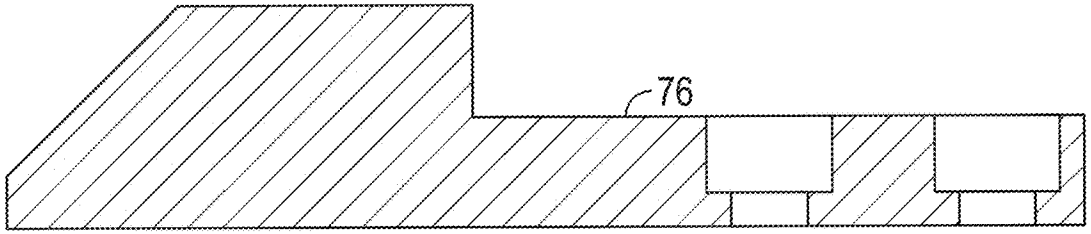
FIG. 12D is a sectional view of the guide taken along lines D-D of FIG. 12C.
Figure 12:
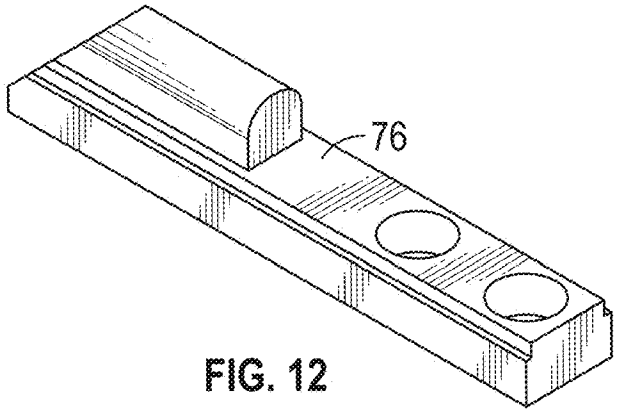
FIG. 12 is a perspective view of the bolt charging handle guide.
Figure 12C:
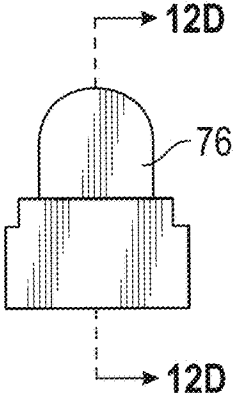
FIG. 12C is an end elevation view of the guide.
Figure 13:
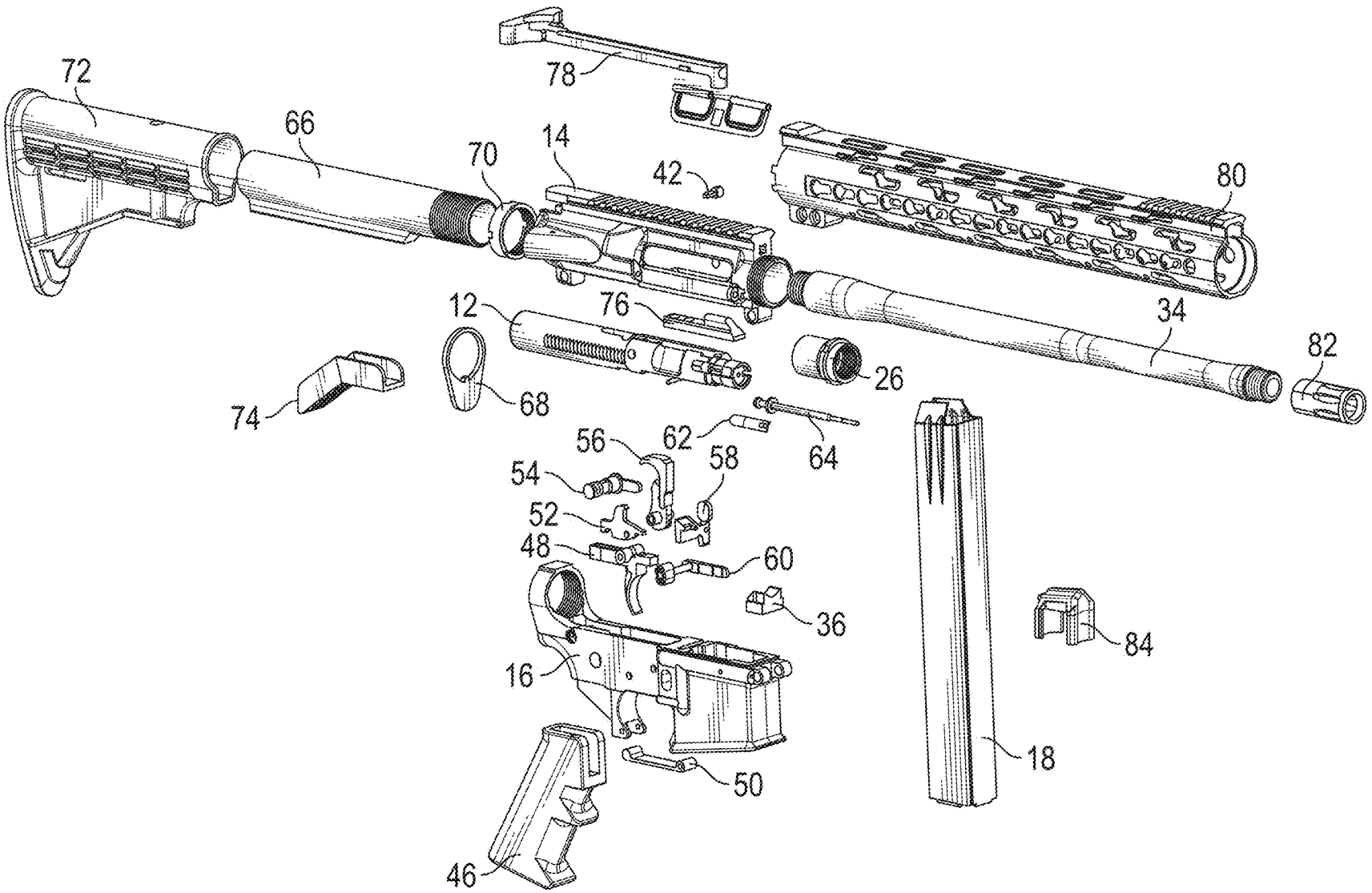
FIG. 13 is an exploded perspective view of the semi-automatic, select fire and/or automatic rifle according to the present invention.
Figure 14:
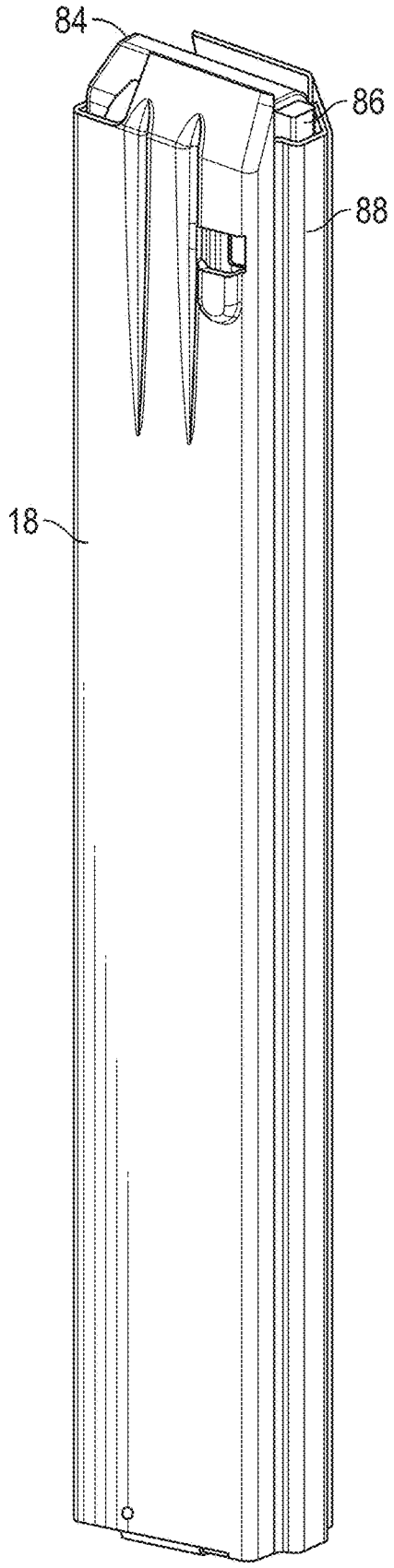
FIG. 14 is a perspective view of the rifle magazine.
Figure 15:
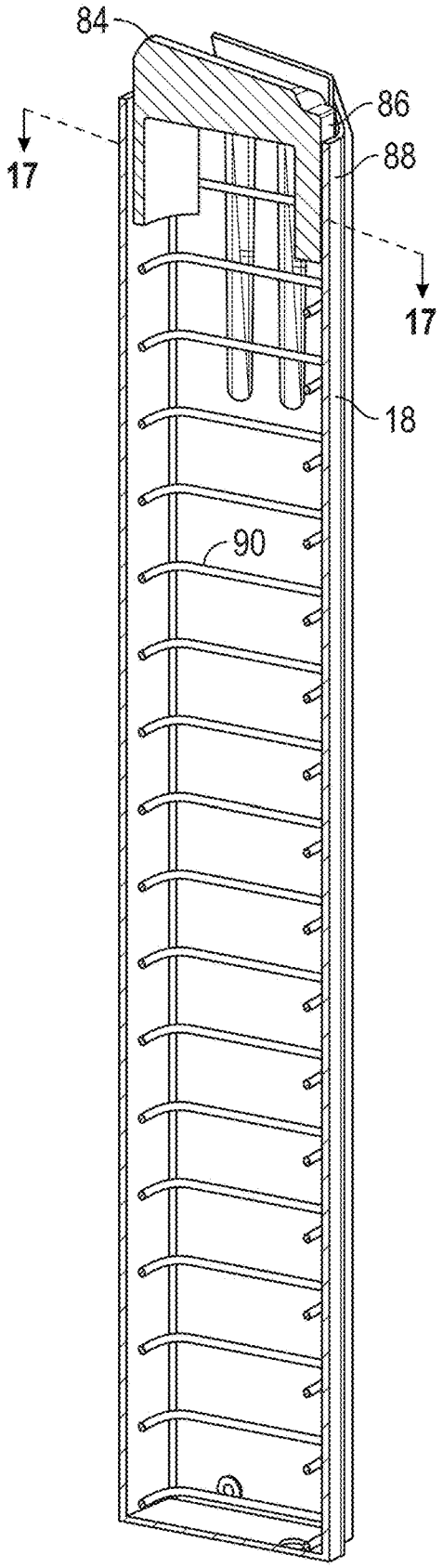
FIG. 15 is a longitudinal sectional view of the magazine.
Figure 16:
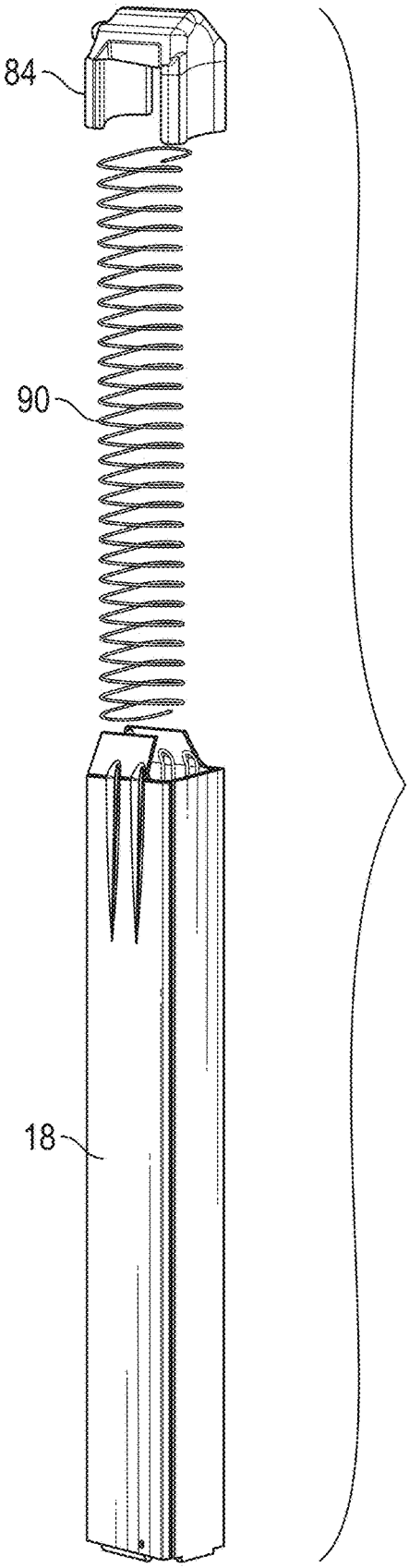
FIG. 16 is an exploded view of the magazine.
Figure 17:
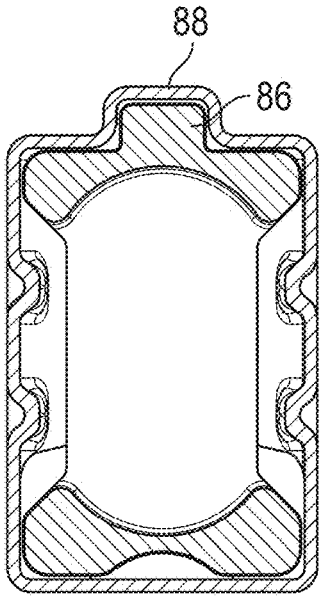
FIG. 17 is a lateral sectional view of the magazine taken along line 17-17 of FIG. 15.

A bolt guide 76 (FIG. 12) is provided on the bolt 12. A standard charging handle 78 is provided to move the bolt between the forward and rearward positions for loading a round.

A conventional free float tube 80 surrounds the barrel 34. A muzzle device 82 is threadably mounted on the front end of the barrel 34.

The magazine 18 is removably inserted into the lower receiver 16 and retained by the catch 60. The magazine 18 is adapted to hold a plurality of cartridges 20 of the desired small caliber, such a 9 mm and/or 45 ACP. A follower 84 slidably mounts within the magazine shell. The cartridges 20 are pushed into the chamber, in a direction perpendicular to the chamber axis, by the follower 84 via upward force by the spring 90 in the magazine 18. The perpendicular feed direction reduces the spring force, as compared to prior art inclined magazine feeds. The follower includes a unique rib 86 which is received in a groove 88 in the magazine. The rib 86 and groove 88 design allow for the bolt hold open to actuate the bolt stop, which allows the bolt to stop open upon the firing of the last cartridge from the magazine. This will indicate to the user that the magazine 18 is empty and a new magazine needs to be loaded into the lower receiver 16 of the rifle 10. The rib 86 keeps dirt and other contaminants out of the magazine 18. Also, in low light or dark environments, the rear magazine groove 88 provides a tactile feel to the user so as to properly orient the magazine 18 for loading into the lower receiver 16.

When the last cartridge is shot from the rifle 10, the follower 84 extends upwardly. Thus, the bolt automatically locks after the last cartridge is fired, contrary to the prior art wherein the bolt did not lock after the last shot.

The rifle 10 is a complete rifle, and operates in a manner similar to a conventional AR15 shooting a .223 or 5.56×45 mm round, except that the rifle 10 shoots a pistol round. No disassembly or substitution of parts is required.

From the foregoing, it can be seen that the present invention accomplishes at least all of the stated of objectives.

What is claimed is:

1. A semi-automatic, select fire, and/or fully automatic rifle for shooting a cartridge, comprising:

an upper receiver having a cartridge chamber having a longitudinal axis;

a lower receiver pinned with pins to and below the upper receiver and having a magazine well;

a one-piece bolt within the upper receiver and slidable without rotation between forward and rearward positions;

a magazine removably insertable into the magazine well;

a butt stock extending rearwardly from the lower receiver;

a barrel extending forwardly from the upper receiver and having a rifled bore; and wherein the bolt has a reduced diameter forward end to engage a rear end of the cartridge when the bolt is in the forward position to preclude out of battery firing.

2. The semi-automatic, select fire, and/or fully automatic rifle of claim 1 further comprising an ejector in the upper receiver.

3. The semi-automatic, select fire, and/or fully automatic rifle of claim 1 further comprising a feed ramp in the lower receiver to direct the cartridge from the magazine into the chamber.

4. The semi-automatic, select fire, and/or fully automatic rifle of claim 1 further comprising the magazine extending perpendicularly to the longitudinal axis and being adapted to feed the cartridge into the cartridge chamber; the magazine having a chamber for holding a plurality of the cartridges, and the chamber having a longitudinal axis extending in a straight line.

5. The semi-automatic, select fire and/or fully automatic rifle for shooting a cartridge of claim 1 wherein the bolt has a recess in the forward end to receive a rear end of the cartridge.

6. The semi-automatic, select fire, and/or fully automatic rifle of claim 1 wherein a forward end of the bolt completely encloses a rear end of the cartridge when the bolt is in the forward position to preclude out of battery firing.

7. A semi-automatic, select fire, and/or fully automatic rifle, comprising:

an upper receiver having a cartridge chamber having a longitudinal axis;

a lower receiver pinned with pins to and below the upper receiver and having a magazine well;

a bolt within the upper receiver and movable between forward and rearward positions;

a magazine removably insertable into the magazine well;

a butt stock extending rearwardly from the lower receiver;

a barrel extending forwardly from the upper receiver and having a rifled bore; and an ejector pinned with a pin directly to the upper receiver so that the ejector is fixed in a stationary position on the upper receiver.

8. The semi-automatic, select fire, and/or fully automatic rifle of claim 7 wherein the bolt has an integrated carrier.

9. The semi-automatic, select fire, and/or fully automatic rifle of claim 7 further comprising a feed ramp in the lower receiver to direct the cartridge from the magazine into the chamber.

10. The semi-automatic, select fire, and/or fully automatic rifle of claim 7 further comprising the magazine extending perpendicularly to the longitudinal axis and being adapted to feed a cartridge into the cartridge chamber; the magazine having a chamber for holding a plurality of cartridges, and the magazine chamber having a longitudinal axis extending in a straight line.

11. The semi-automatic, select fire, and/or fully automatic rifle of claim 7 wherein a forward end of the bolt completely encloses a rear end of the cartridge when the bolt is in the forward position to preclude out of battery firing.

12. The semi-automatic, select fire and/or fully automatic rifle of claim 7 wherein the bolt has a recess in the forward end to receive a rear end of the cartridge.

* * * * *